US005911350A

United States Patent [19]

Bolger et al.

[11] Patent Number: 5,911,350

[45] Date of Patent: Jun. 15, 1999

[54] FASTENER DETECTION AND FIRING CONTROL SYSTEM FOR POWERED FASTENER DRIVING TOOLS

[75] Inventors: Richard P. Bolger, Schaumburg; G. Michael Velan, Mount Prospect; George G. Dewey, Palatine; E. Jonathan Wendling, Algonquin, all of Ill.

[73] Assignee: Illinois Tool Works Inc., Glenview, Ill.

[21] Appl. No.: 08/869,984

[22] Filed: Jun. 5, 1997

Related U.S. Application Data

[63] Continuation-in-part of application No. 08/679,526, Jul. 12, 1996, Pat. No. 5,794,831.

[51] Int. Cl.[6] ..... B25C 1/08

[52] U.S. Cl. ..... 227/2; 227/8; 227/10; 227/130; 173/20

[58] Field of Search ..... 227/8, 130, 2, 227/9, 10; 173/20

[56] References Cited

U.S. PATENT DOCUMENTS 4,978,045 12/1990 Murakami et al. ..... 227/1

5,181,315 1/1993 Goodsmith ..... 29/798

FOREIGN PATENT DOCUMENTS 56989 8/1982 European Pat. Off. .

544471 6/1993 European Pat. Off. .

711634 5/1996 European Pat. Off. .

*Primary Examiner*—Scott A. Smith

*Attorney, Agent, or Firm*—Mark W. Croll; Thomas W. Buckman; John P. O'Brien

[57] ABSTRACT

A fastener detection system is provided for both internal combustion and powder actuated fastener driving tools, and similar powered fastener driving tools. A sensor disposed at a portion of a fastener supply path detects the presence or absence of a fastener. In the combustion tool, either or both of fuel delivery and combustion ignition are disabled when no fastener is detected. In the powder actuated tool an indicator notifies an operator when the sensor detects the absence of a fastener. The indicator may also be incorporated into the combustion tool.

20 Claims, 4 Drawing Sheets

70
+V
100
60
0
5
R3 10K
A3
76
A4
68
66
78
D2
D3
72
R1 4.3K
D1
R2 2M
A1
C1
A2
C3
82
84
C1
C2
R9 432K 1%
VR1 100K
R8 178K 1%
Q2
5.1K
80
25.4K 1%
88R 1%
510K
100PF
55
74

FASTENER DETECTION AND FIRING CONTROL SYSTEM FOR POWERED FASTENER DRIVING TOOLS

This is a continuation-in-part of application Ser. No. 08/679,526, filed Jul. 12, 1996, now U.S. Pat. No. 5,794, 831, and priority is claimed therefrom in accordance with 35 U.S.C. §120.

BACKGROUND OF THE INVENTION

The present invention relates generally to improvements in portable fastener driving tools, such as powder actuated and combustion powered tools, and specifically to improvements relating to the detection of fasteners, the disabling of firing systems when the absence of a fastener is detected, and operator notification when the absence of a fastener is detected.

BACKGROUND OF THE INVENTION

Portable combustion powered tools for use in driving fasteners into workpieces are described in commonly assigned patents to Nikolich, U.S. Pat. No. Re. 32,452, and U.S. Pat. Nos. 4,552,162, 4,483,473, 4,483,474, 4,403,722, and 5,263,439, all of which are incorporated by reference herein. Similar combustion powered nail and staple driving tools are available commercially from ITW-Paslode of Lincolnshire, Ill. under the IMPULSE® brand.

Such tools incorporate a generally gun-shaped tool housing enclosing a small internal combustion engine. The engine is powered by a canister of pressurized fuel gas, also called a fuel cell. A battery-powered electronic power distribution unit produces the spark for ignition, and a fan located in the combustion chamber provides for both an efficient combustion within the chamber, and facilitates scavenging, including the exhaust of combustion by-products. The engine includes a reciprocating piston having an elongate, rigid driver blade disposed within a piston chamber of a cylinder body.

A valve sleeve is axially reciprocable about the cylinder and, through means of a linkage, moves to close the combustion chamber when a work contact element at the end of a nosepiece connected to the linkage is pressed against a workpiece. This pressing action also triggers a fuel metering valve to introduce a specified volume of fuel gas into the closed combustion chamber from the fuel cell. The metering valve may take the form of a solenoid valve, which is powered by the battery, or may be a purely mechanical valve.

Upon the pulling of a trigger switch, which causes the ignition of a charge of gas in the combustion chamber of the engine, the piston and driver blade are forced downwardly to impact a positioned fastener and drive it into the workpiece. As the piston is driven downward, a displacement volume enclosed in the piston chamber below the piston is exhausted through one or more exit ports provided within the lower end of the cylinder. After impact, the piston then returns to its original, or "ready" position through differential gas pressures within the cylinder. Fasteners are fed into the nosepiece from a supply assembly, such as a supply tube or magazine, where they are held in a properly positioned orientation for receiving the impact of the driver blade.

A high velocity combustion powered tool of the same type having an extended piston chamber or cylinder is the subject of a co-pending U.S. patent application Ser. No. 08/536,854. The extended cylinder increases the stroke of the piston, thereby allowing for increased piston velocity and transfer of power from the driver blade to the fastener.

In one embodiment, the extended length also allows an operator to stand generally upright while driving fasteners which are at the foot level. Fasteners are loaded into a supply tube at operator level, and positioned for firing into a nosepiece. Details of an operator level loading supply tube and associated nosepiece are disclosed in commonly-assigned U.S. Pat. No. 5,199,624 to Dewey et al., which is incorporated by reference herein.

One inconvenience associated with combustion tools is the need for fuel cell replacement. Fuel cells used in the combustion tools may be used for a fixed number of combustion cycles before becoming empty, at which time replacement is required. Convenience is enhanced when a cell lasts for a longer number of firings before replacement is necessary.

On occasion, the supply assembly delivering fasteners into the nosepiece may jam or be empty. While such condition is easily remedied, an operator may attempt to fire the tool before realizing that a fastener is not appropriately positioned in the nosepiece. Such blank firing reduces the number of fasteners driven per fuel cell, requiring more frequent fuel cell replacement.

In addition, the total number of fasteners driven before the tool itself needs to be serviced is reduced by blank firings. Among the parts which become worn or broken over time is the piston. At each firing, the piston violently impacts a bumper disposed at the bottom of the cylinder. Over time, this contact can cause premature failure of the piston if blank firings are permitted to occur. Useful tool life is therefore also reduced by blank firings since fewer fasteners are driven before service is necessary.

Similar problems are encountered in powder actuated (PAT) fastener driving tools. Various features of PAT fastener driving tools are described, for instance, in U.S. Pat, No. 5,199,625 to Dewey et al. and U.S. Pat. No. 4,824,003 to Almeras, et al. which are incorporated by reference herein. PAT tools are commercially available from Societe de Prospection et d' Inventions Techniques of Valence, France, a subsidiary of Illinois Tool Works, Inc. of Glenview, Ill.

In contrast to the internal combustion tools, PAT tools rely upon a powder cartridge loaded magazine style into the combustion chamber. Similarly to combustion tools, efficiency of PAT tools is decreased by blank firings. Indeed, since a single powder cartridge is used for a combustion in the PAT tools, blank firings are even more inconvenient and wasteful than in an internal combustion tool, in which the fuel cell is useful for many firings.

OBJECTS OF THE INVENTION

Accordingly, it is an object of the present invention to provide an improved combustion powered tool which extends the useful fuel cell and tool life.

Another object of the present invention is to provide an improved combustion powered tool in which firing is prevented when a number of fasteners in a magazine supply tube is reduced to a predetermined number.

A further object of the present invention is to provide an improved combustion powered tool wherein an operator is notified when the number of fasteners in the magazine supply tube is reduced to a predetermined number.

A still further object of the invention is to provide an improved combustion powered tool including an optical detector to detect when the number of fasteners in the magazine supply tube is reduced to a predetermined number.

An additional object of the present invention is to provide an improved PAT tool wherein an operator is notified when the number of fasteners in the magazine supply tube is reduced to a predetermined number.

SUMMARY OF THE INVENTION

The above-listed objects are met or exceeded by the present improved internal combustion powered fastener tool, which prevents firing when the fastener supply tube level is reduced to a predetermined number. A detector placed along the fastener supply path determines whether or not a fastener is present. When a fastener is detected, switches are activated allowing fuel to be delivered from the fuel cell into the combustion chamber, and allowing an ignition spark to ignite the fuel. If a fastener is not detected, the switches may disable either or both fuel delivery and fuel ignition.

In a preferred embodiment, an extended length tool includes an optical sensor as the fastener detector. Positioning of a fastener into a predetermined part of the fastener supply path causes the optical sensor to enable fuel delivery and ignition circuits. The tool may also include an indicator to notify the operator when a fastener is not detected. The indicator may be visible, such as a light emitting diode (LED), and/or audible. An alternative to the optical sensor is a Hall effect sensor.

Various features of the present invention may also be applied to PAT tools. Use of a fastener detector and indicator on a PAT tool in accordance with the present invention provides notice to an operator that fasteners should be loaded prior to firing.

A specific embodiment of the present invention provides a powered tool arranged for driving a driver blade to impact a fastener. A housing includes a main chamber enclosing a power source. An end of the driver blade is accepted into an aperture formed within a nosepiece associated with the housing. The aperture accepts a fastener and guides the end of the driver blade toward impact with the fastener. Fasteners are supplied into the nosepiece by a fastener supply tube associated with the housing. A fastener detector detects the presence or absence of a fastener within a portion of a fastener supply path defined by the supply tube. In response to a signal supplied by the detector, an indicator notifies an operator when the fastener detector detects the absence of a fastener.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
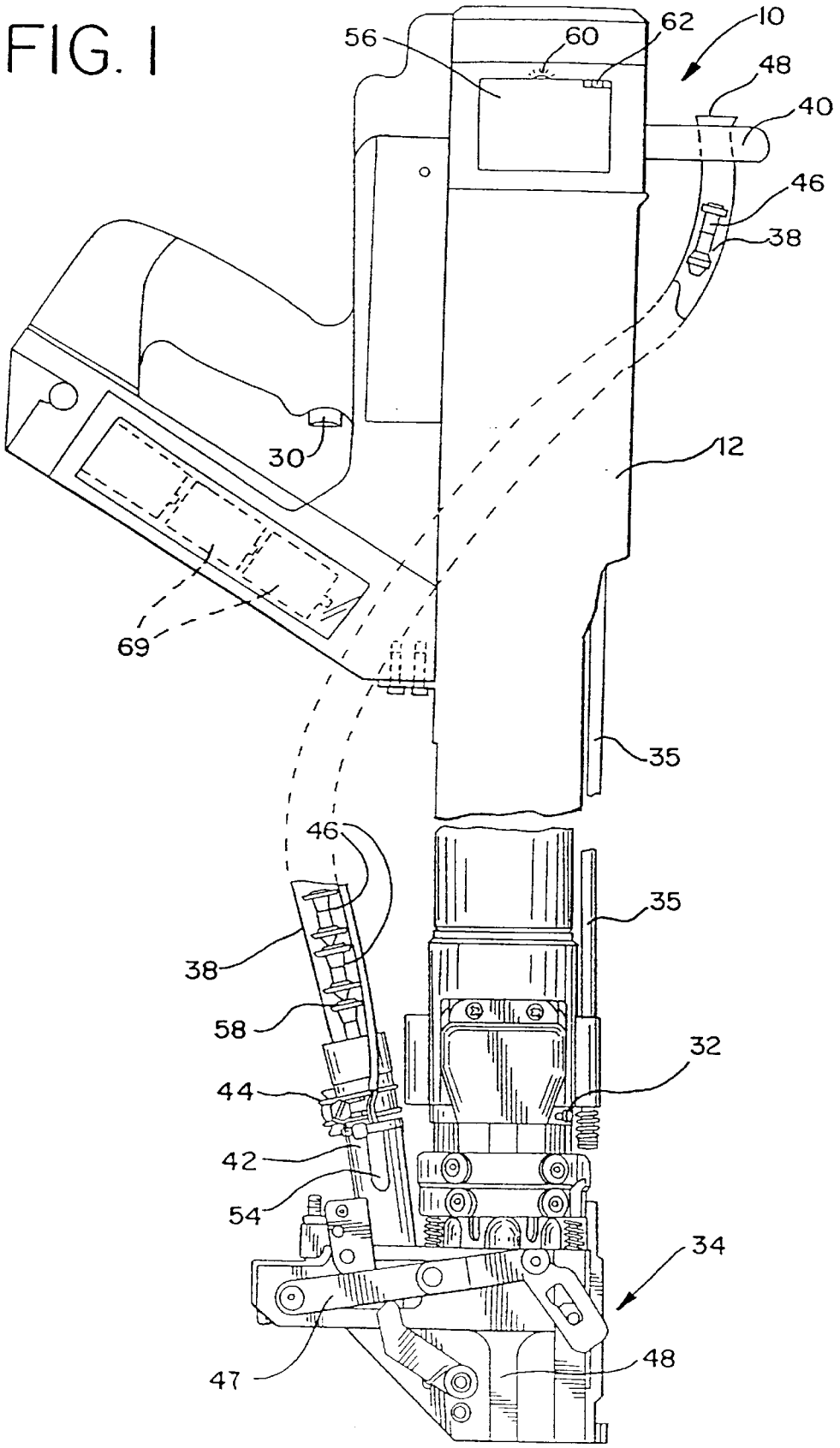
FIG. 1 is fragmented side view of an extended stroke combustion fastener tool constructed in accordance with the present invention.
Figure 2:
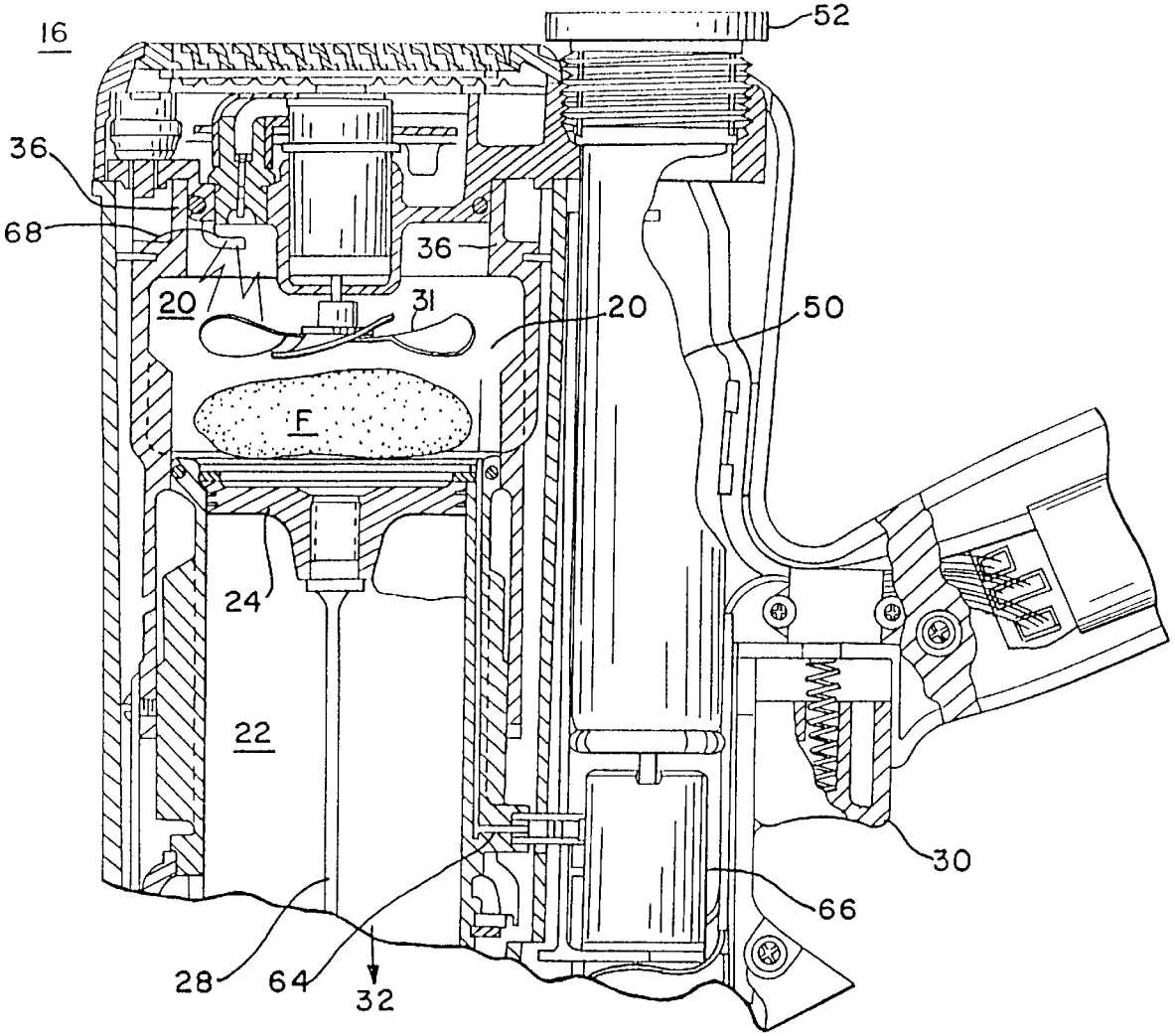
FIG. 2 is an enlarged cross-sectional view of the power source of the fastener tool of FIG. 1.

Referring now to FIGS. 1 and 2, the preferred embodiment of an extended length high velocity combustion fastener tool suitable for practicing the present invention is generally designated 10. A main housing 12 of the tool 10 encloses a self contained internal power source 16, which is detailed in FIG. 2. The power source 16 includes a combustion chamber 20 that communicates with a cylinder 22. A piston 24 is disposed within the cylinder 22 and is connected to a driver blade 28. In the preferred embodiment, the cylinder 22 is of the extended length type and as such is considerably longer than the driver blade 28.

Through depression of a trigger 30, an operator induces combustion of a measured amount of propellant F, such as MAPP gas, within the combustion chamber 20. Propellant F is agitated by a fan 31 to help speed the combustion. In response to the combustion, the piston 24 is driven toward a terminal end 32 of the cylinder 22. As the piston 24 approaches the terminal end 32, the driver blade 28 will be guided into a nosepiece 34 and impact a fastener (not shown) held above a workpiece by the nosepiece 34. Although it is contemplated that the present tool will be used with a variety of fasteners, it is preferred that the fastener be of the so-called pin type, described in more detail in U.S. Pat. No. 5,199,625. Impact of the driver blade 28 drives the fastener into a workpiece or substrate. As a safety feature, and to regulate the use of fuel, the firing of the tool 10 will not occur unless the nosepiece 34 is pressed against a workpiece. Such placement causes a linkage rod 35 to be pushed upward, which moves a valve sleeve 36 to seal the combustion chamber 20. Details concerning sealing of the combustion chamber 20, and related mechanisms may be found in the previously mentioned Nikolich patents.

Upon ignition of propellant F in the combustion chamber 20, the piston 24 is driven toward the terminal end 32 of the cylinder 22. A bumper (not shown) is disposed within the cylinder 22 at its terminal end 32 and defines the end of travel of the piston 24 toward the terminal end 32, and differential gas pressures return the piston 24 back toward combustion chamber 20 after the piston 24 completes its downward travel.

The tool 10 illustrated in FIG. 1 is a so-called extended length cylinder embodiment. The particular illustrated embodiment of the extended length cylinder 22 allows an operator standing generally upright to operate the tool 10 to drive fasteners at foot level. An important additional feature of the extended length tool 10 is the increase in the stroke of the piston 24. Through the increased stroke, velocity of the piston 24 at impact and efficiency of power transfer is enhanced, when compared to an otherwise identical combustion powered tool having a smaller stroke.

As is known in the art, a PAT tool has a similar outer configuration to the tool 10 of FIG. 1, but relies upon explosion of a powder cartridge to drive the piston 24. Similar to a firearm, a powder cartridge is disposed in a combustion chamber, which is equivalent to the chamber 20 of the combustion tool 10, is located above the piston 24, and is ignited through the striking of a hammer to drive a driver blade into a nosepiece for impact with a fastener.

A fastener supply tube 38 is a preferred supply assembly applicable to both the combustion tool 10 and PAT tools. An upper end of the flexible supply tube 38 is typically attached to an upper portion of the housing 12, such as a handle 40, while a lower end of the supply tube 38 is attached to a nosepiece tube 42. The supply tube 38 may be attached at both ends by a suitable clamp 44. Fasteners 46 fed into an open end 48 of the supply tube 38 descend under the influence of gravity toward the nosepiece 34 and into the nosepiece tube 42. When an operator presses the nosepiece 34 against a workpiece, a lowermost fastener 46 within nosepiece 34 is pushed by a shuttle block (not shown) attached to a linkage 47 until it is positioned within a channel 48 of the nosepiece 34. In this position, a fastener 46 may be struck by the driver blade 28.

Both the PAT and combustion tools are utilized in environments which demand rapid cycling operation. An operator frequently repositions and fires the tool in rapid fashion to facilitate production. Operating under these or other conditions, an operator may fail to notice when the supply tube 38 becomes empty. Positioning of the nosepiece 34 near an operator's foot and the opaque nature of the nosepiece 34 is an additional impediment to recognition that the supply tube 38 has become empty. Opaqueness of the supply tube 38, either by original design or accumulation of work environment dust and dirt thereon, similarly serves to reduce visibility of an empty condition of the supply tube 38.

Whatever the reason for an operator's failure to notice that the supply tube 38 has become empty, such failure to notice may lead to a blank firing of the tool 10, that is a firing of the tool 10 when no fastener 46 is positioned over the channel 48. Blank firing of the tool 10 reduces useful tool life since the wear associated with firing of the tool is produced even though no fastener is driven.

Additionally, blank firing wastes propellant. In a PAT tool, a blank firing wastes a powder cartridge, requiring a magazine of powder cartridges to be emptied more quickly. In the combustion tool 10, a fuel cell 50 shown in FIG. 2 includes sufficient propellant F to drive a fixed number of fasteners, and propellant is wasted during a blank firing thereby requiring more frequent replacement of the fuel cell 50 by operator removal of a cap 52.

These and other inefficiencies associated with blank firing are alleviated in accordance with the present invention. Referring again to FIG. 1, the tool 10 in accordance with the present invention includes a fastener detector sensor 54 disposed along the fastener supply path defined by the supply tube 38 and nosepiece 34, including the nosepiece tube 42. Preferably, the sensor 54 takes the form of an optical sensor that is responsive to a light source. The optical detector and source, such as a photodetector and LED pair, are mounted at a predetermined location in the fastener supply path defined by the supply tube 38 and the nosepiece 34 so that the presence of a fastener will optically separate the detector and source. The LED and photodetector may be mounted internally or externally to the supply path. External mounting requires that the predetermined location in the fastener supply path be transparent to allow light from the LED to reach the photodetector, while internal mounting must avoid mechanical interference between fasteners 46 and the sensor components. External mounting is more convenient for existing tools, while either mounting may be easily incorporated into the design of modified tools.

An alternative to the LED and optical sensor arrangement is a Hall effect sensor 55, which has a proximity detection capability that obviates the need to place the switch within the actual fastener supply path. Use of the Hall effect sensor 55 requires fine calibration, however, and the sensor has a tendency to drift during operation. In addition, the Hall effect sensor 55 is only responsive to fasteners 46 made of soft magnetic material, whereas the optical sensor will operate irrespective of the type of material used for the fastener 46. With either type of sensor arrangement, the presence or absence of a fastener 46 adjacent the sensor 54 is communicated to a fastener detection circuit within a circuit portion 56 of the housing 12 by means of leads 58.

Other sensors, such as a contact sensor may also be used in place of the preferred optical sensor. However, the contact sensor requires undesirable modification of the fastener supply tube 38 to permit fastener-to-sensor contact, thus introducing the potential for mechanical interference.

In the mechanically actuated PAT tools and in combustion tools having a mechanical fuel metering valve, warning is provided to an operator when the sensor 54 detects the absence of a fastener 46 in the portion of the supply path adjacent thereto. The warning is also preferably provided in the combustion tool 10 including an electrically controlled solenoid fuel metering valve, and may take the form of a light 60 disposed within an operator's line of sight, and/or a grille 62 for an audible alarm, or other suitable alarm system sufficient to notify an operator when the sensor 54 detects the absence of a fastener 46. Upon notice provided through the grille 62 or the light 60, an operator loads additional fasteners 46 into the open end 48 of the supply tube 38 to avoid a blank firing.

In tools including electrical components in the firing system, blank firing may also be prevented when no fastener 46 is detected. In addition, waste of propellant F may be avoided if the propellant F is normally supplied through the use of electrical fuel metering components.

Taking advantage of the electrical components incorporated into the combustion powered tool 10, the present invention contemplates disabling combustion ignition of the combustion powered tool 10 when the sensor 54 detects the absence of a fastener 46 in the portion of the fastener supply path adjacent the sensor 54. Referring now to FIG. 2, propellant F is introduced into the combustion chamber 20 through fuel passageway 64 under the control of a solenoid fuel metering valve assembly 66. Electrical power for the valve assembly 66, fan 31, and spark coil 68 is provided by at least one battery 69 (best seen in FIG. 1).

In conventional combustion powered tools, introduction of propellant F under the control of the valve assembly 66 occurs in response to pressing of the nosepiece 34 against a workpiece. Movement of the fan 31 to agitate the propellant F also occurs in response to the pressing of the nosepiece 34. Firing then occurs when the spark coil 68 ignites the propellant F. If blank firing is prevented solely by disablement of the spark coil 68, propellant F is still introduced into the combustion chamber 20 after the valve sleeve 36 is closed by action of the linkage rod 35. An operator prevented from firing the tool 10 by disablement of the spark coil 68 must lift the tool to restart the firing process thereby re-opening the combustion chamber 20 when the valve sleeve 36 moves down, and releasing the propellant F which was introduced into the chamber 20. This waste of propellant F is avoided by disabling the preferred electromechanical solenoid fuel metering valve assembly 66 when the sensor 54 detects that no fastener 46 is present.

Figure 3:
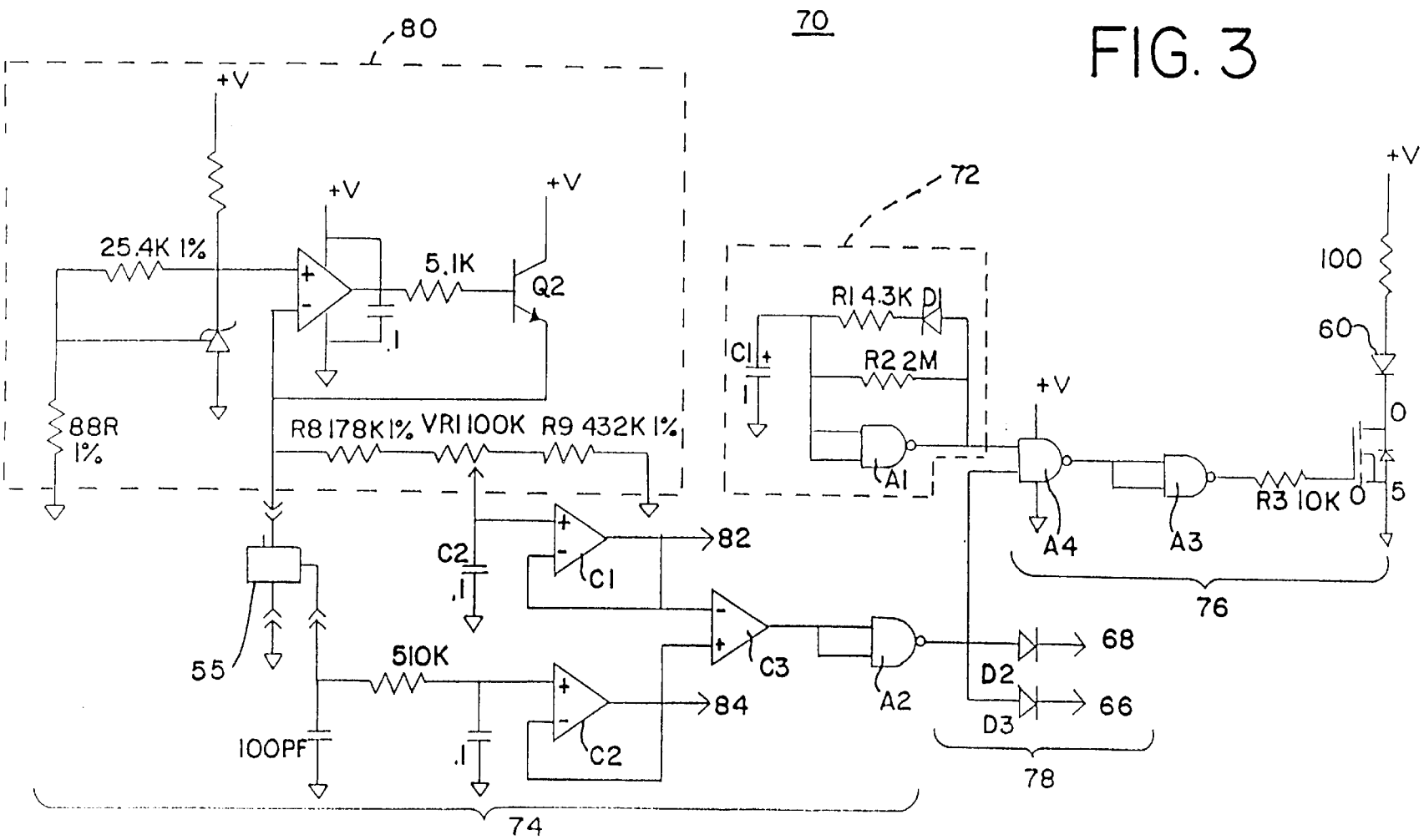
FIG. 3 is a fastener detection and combustion disabling circuit constructed in accordance with the present invention for use with a Hall effect fastener sensor.

Referring now to FIG. 3, shown is a combustion disabling and alarm circuit 70 for use where the sensor 54 comprises a Hall effect sensor 55. The circuit generally includes an oscillator section 72, a sensor section 74, an alarm section 76, and a disabling section 78.

The oscillator section 72, including resistors R1–R2, capacitor C1, diode D1 and NAND gate A1, produces power pulses preferably at a low rate to reduce power consumption from the battery 69 by driving light emitting diode 60 (D2) for short pulsating periods. Of course, the same technique is preferably used to drive an audio alarm (not shown in FIG. 3) used in addition to or in place of the light emitting diode 60. While circuit values may be chosen to suit a particular application, the illustrated values produce an oscillation pulse of approximately 1 ms/s.

The sensor section includes a stable voltage source 80 for powering the Hall effect sensor 55, and for providing a selectable voltage to the voltage-following comparator C1 through a voltage divider consisting of resistors R8 and R9, and variable resistor VR1. The voltage output from the Hall effect sensor 55 is followed by the output of comparator C2. When the Hall effect sensor 55 detects a fastener 46, the voltage output from the comparator C2 exceeds the voltage output from comparator C1 to drive the output of comparator C3 high. This drives the output of NAND gate A2 low, thereby disabling diodes D2 and D3, which otherwise respectively provide signals to disable the spark coil 68 and the fuel metering valve assembly 66. In addition, the low potential output from the NAND gate A2 disables NAND gate A3 through gate A4 to prevent pulses from the oscillating circuit section 72 from driving the light emitting diode 60.

Modification of the disabling and alarm circuit 70 for the PAT tools (and for mechanically actuated combustion tools) simply requires omission of the disabling circuit section 78, since there is no electrical system to disable combustion in typical PAT tools. Exact placement of the Hall effect sensor 55 along the fastener supply path determines when combustion disabling or alarming occurs. In the position illustrated in FIG. 1, disabling occurs when two fasteners 46 are remaining within the nosepiece 34 including the nosepiece tube 42. This is a convenient location for mounting the Hall effect sensor 55, but other locations may also be used. Movement of the sensor 54 or 55 to a lower portion of the fastener 46 supply path could reduce the predetermined number of fasteners which trigger disabling and alarm to one or zero. The number of fasteners 46 may be similarly raised by moving the sensor 54 or 55 upward toward or upon the fastener supply tube 38. The exact placement of the sensor 54 will depend upon the shape of the fastener used, and should be aligned to produce the strongest response. As an example, the preferred pin type fasteners 46 produced the strongest response when the Hall effect sensor 55 was placed along the supply path to align with a washer portion of the pin.

For reliability and ease of manufacture, the Hall effect sensor 55 preferably has an output which is proportional to a magnetic field generated by a magnet attached to the back of the sensor when it is mounted to the fastener supply tube 38. Outside the presence of a magnet, the output of the Hall effect sensor 55 would generally be a fixed multiple of the voltage supplied from the voltage source section 80, for instance ½. This will increase once the magnet is attached, and also increases when a fastener 46 is proximate to the Hall effect sensor 55. However, there may be a variance in the amount of increase produced by the magnet depending upon the properties and exact sizing of the magnet which is used.

Rather than providing more exacting tolerances for the magnet, variances in the produced magnetic field are accounted for during tool manufacture by setting the voltage at terminal 82 depending upon fastener and no-fastener voltages measured at terminal 84. Using the logic applied in the embodiment of FIG. 3, the output of C2 (terminal 84) should be smaller than that presented by C1 (terminal 82) when no fastener 46 is proximate to the Hall effect sensor 55. In the presence of a fastener 46 the voltage presented by C2 should exceed that presented by C1. Preferably, the voltage at terminal 82 is set during manufacture through adjustment of the variable resistor VR1 to be the midpoint between the no-fastener and fastener voltages measured at pin 84. This setting may be accomplished at any time subsequent to mating of the Hall effect sensor 55 and its magnet.

This process also confirms that the polarity of the magnet is properly aligned with respect to the Hall effect sensor 55. When the magnet polarity is in the appropriate direction, a fastener 46 causes an increase in the voltage at terminal 84. A decrease is observed if the polarity is reversed.

Figure 4:
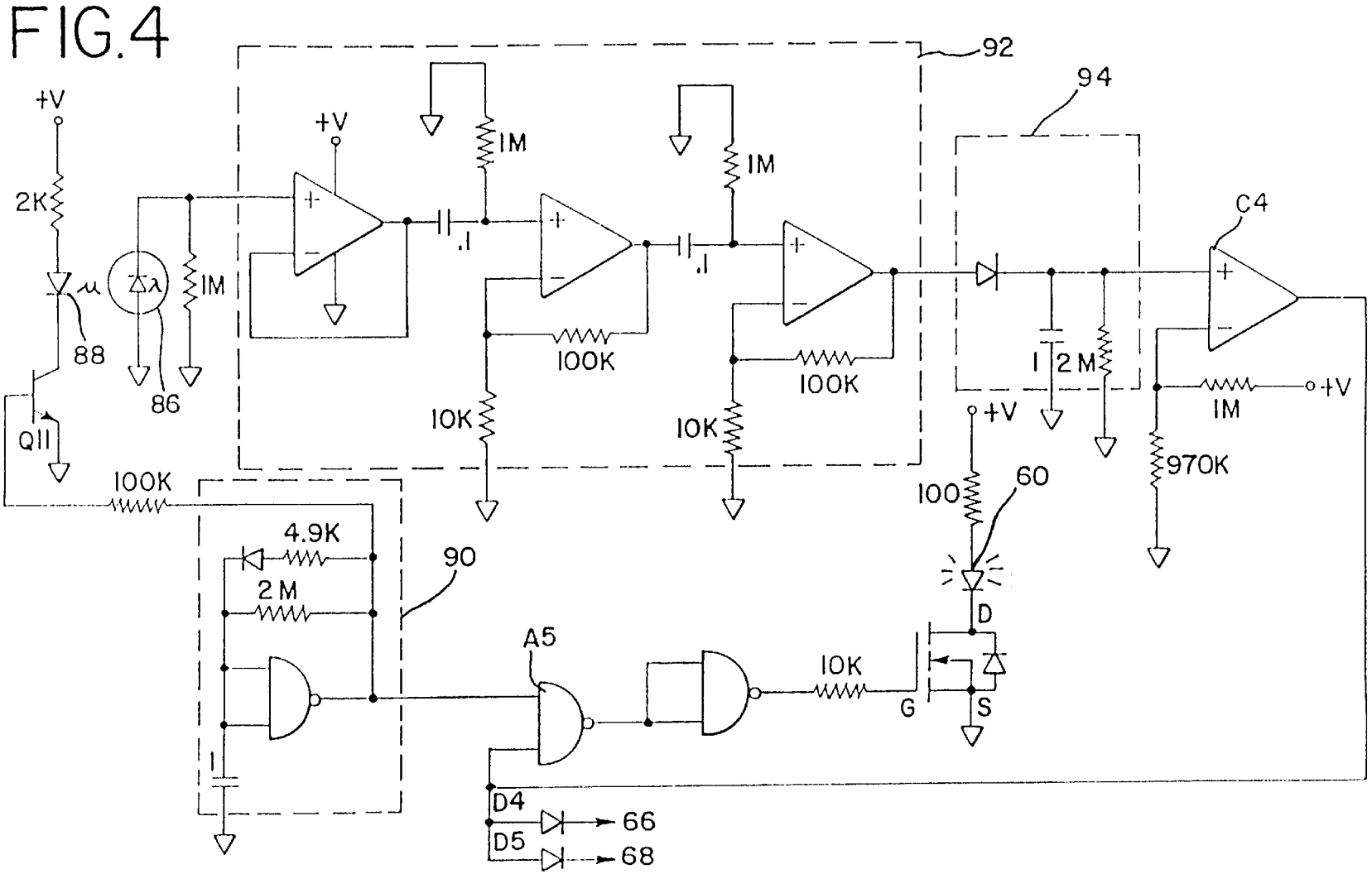
FIG. 4 is a fastener detection and combustion disabling circuit constructed in accordance with the present invention for use with an optical fastener sensor.

These calibration difficulties are overcome by employing a sensor 54 including an optical detector and source, such as a photodetector 86 and LED 88, as shown in FIG. 4. The photodetector 86 and LED 88 are arranged so that a pulse of light is allowed across the portion of the supply path where the sensor 54 is mounted in the absence of a fastener 46, and is blocked when a fastener 46 is present.

An oscillator circuit 90 generates a 2 ms pulse every second which causes the driver transistor Q11 to produce a similarly short pulse of light in the LED 88. If no fastener 46 is present, the light pulse is received by the photodetector 86. A signal from the photodetector 86 is amplified by an amplifier 92, formed from a buffer stage and two capacitor coupled gain stages. The capacitor coupling eliminates DC voltages. Peaks in the amplified LED signal are detected by a peak detector circuit 94 and used to determine the presence or absence of a fastener 46 by a comparator C4, which has a reference voltage applied to its inverting input. When no fastener 46 is present an output is produced by the comparator C4 to enable the NAND gate A5, thereby allowing the oscillator circuit 90 to pulse the LED 60 (also shown in FIG. 1). When applied to a combustion tool 10, diodes D4 and D5 are preferably used to provide signals to disable the spark coil 68 and the fuel metering valve assembly 66. Of course, when a fastener 46 is present, the NAND gate A5 is disabled so that the LED 60 is not pulsed and disable signals are not provided by diodes D4 and D5. Modification of the circuit of FIG. 4 for PAT tools is realized by leaving outputs of the diodes D4 and D5 unconnected, or by omitting the diodes D4 and D5 and outputs entirely.

As described above with reference to the drawings, features of the present invention provide for operator notification when fasteners have been depleted to a predetermined number in PAT and combustion powered tools, and disabling of combustion in the combustion tools when the same condition occurs. Some or all of these features might also be applied to other tools, such as pneumatic tools. Thus, while a particular embodiment of the fastener detection and firing control system for combustion and PAT tools of the invention has been shown and described, it will be appreciated by those skilled in the art that changes and modifications may be made thereto without departing from the invention in its broader aspects and as set forth in the following claims.

What is claimed is:

1. A powered tool constructed to drive a driver blade in response to power from a power delivery source so as to impact a fastener and drive it into a workpiece, comprising:

a housing;

a combustion chamber defined within said housing;

means for supplying a combustible fuel to said combustion chamber;

means disposed within said combustion chamber for igniting said combustible fuel supplied to said combustion chamber;

a driver blade disposed within said housing for driving a fastener into a workpiece;

a nosepiece operatively connected to said housing, means defining an aperture within said nosepiece for accepting a fastener, and means for guiding an end of said driver blade toward impact with said fastener;

a fastener supply assembly operatively connected to said housing for supplying fasteners into said nosepiece;

optical detector means for detecting the presence and absence of a fastener within a portion of a fastener supply path defined by said fastener supply assembly and said nosepiece and for generating signals indicative of said presence and absence of a fastener within said portion of said fastener supply path; and combustion enabling and disabling means responsive to said signals of said optical detector means for enabling said combustible fuel igniting means when said optical detector means detects the presence of a fastener within said portion of said fastener supply path so that operation of said tool and driving of said fastener can take place, and for disabling said combustible fuel igniting means when said optical detector means detects the absence of a fastener within said portion of said fastener supply path so that a blank firing operation of said tool is prevented.

2. The tool as defined in claim 1, wherein:

said combustible fuel igniting means comprises a spark coil; and said combustion enabling and disabling means comprises circuit means operatively connecting said optical detector means and said spark coil and responsive to said signals of said optical detector means for enabling said spark coil when said optical detector means detects the presence of a fastener within said portion of said fastener supply path, and for disabling said spark coil when said optical detector means detects the absence of a fastener within said portion of said fastener supply path.

3. The tool as defined in claim 2, wherein:

said means for supplying said combustible fuel to said combustion chamber comprises a solenoid fuel metering valve assembly; and said circuit means comprises a fuel delivery switch for enabling said solenoid fuel metering valve assembly when said optical detector means detects the presence of a fastener within said portion of said fastener supply path, and for disabling said solenoid fuel metering valve assembly when said optical detector means detects the absence of a fastener within said portion of said fastener supply path.

4. The tool as set forth in claim 3, wherein said circuit means comprises:

first and second diodes operatively connected to said spark coil and said solenoid fuel metering valve assembly for providing signals to said spark coil and said solenoid fuel metering valve assembly so as to disable said spark coil and said solenoid fuel metering valve assembly when said optical detector means detects the absence of a fastener within said portion of said fastener supply path;

reference voltage means for providing a reference voltage; and a differential comparator operatively connected to outputs of said optical detector means and said reference voltage means and operatively connected to inputs of said first and second diodes for driving said first and second diodes when said optical detector means detects the absence of a fastener within said portion of said fastener supply path, and for disabling said first and second diodes when said optical detector means detects the presence of a fastener within said portion of said fastener supply path.

5. The tool as defined in claim 1, wherein:

said optical detector means comprises an optical light source and an optical light detector located at a lower portion of said fastener supply assembly so that a fastener at said lower portion of said fastener supply assembly prevents a signal from said light source from reaching said light detector.

6. The tool as set forth in claim 5, wherein:

said optical source comprises an LED; and said optical detector comprises photodetector.

7. The tool as set forth in claim 5, further comprising:

indicator means, responsive to said signals of said optical detector means, for notifying an operator when said optical detector means detects the absence of a fastener within said portion of said fastener supply path.

8. The tool as defined in claim 7, wherein said indicator means comprises a light.

9. The tool as defined in claim 7, wherein said indicator means comprises an audio alarm.

10. The tool as set forth in claim 1 further comprising:

a cylinder operatively connected to said combustion chamber; and a piston disposed within said cylinder for movement toward said nosepiece in response to combustion of said combustible fuel within said combustion chamber;

said driver blade being mounted at a first end portion thereof, which is opposite a second end portion thereof which operatively impacts and drives a fastener, within said piston.

11. A combustion powered tool having a self-contained internal combustion power source for creating combustion for driving a driver blade so as to impact a fastener and drive it into a workpiece, comprising:

a housing;

a combustion chamber defined within said housing;

means for supplying a combustible fuel to said combustion chamber;

means disposed within said combustion chamber for igniting said combustible fuel supplied to said combustion chamber;

a cylinder defined within said housing and operatively connected to said combustion chamber;

a piston movably disposed within said cylinder;

a driver blade disposed within said cylinder and operatively connected to said piston so as to be driven by said piston for driving a fastener into a workpiece;

a nosepiece operatively connected to said housing, means defining an aperture within said nosepiece for accepting a fastener, and means for guiding an end of said driver blade toward impact with said fastener;

a fastener supply assembly operatively connected to said housing for supplying fasteners into said nosepiece;

optical detector means for detecting the presence and absence of a fastener within a portion of a fastener supply path defined by said fastener supply assembly and said nosepiece and for generating signals indicative of said presence and absence of a fastener within said portion of said fastener supply path; and combustion enabling and disabling means responsive to said signals of said optical detector means for enabling said means for supplying said combustible fuel to said combustion chamber when said optical detector means detects the presence of a fastener within said portion of said fastener supply path so that operation of said tool and driving of said fastener can take place, and for disabling said means for supplying said combustible fuel to said combustion chamber when said optical detector means detects the absence of a fastener within said portion of said supply path so that a blank firing operation of said tool is prevented.

12. The tool as defined in claim 11, further comprising:

indicator means, responsive to said signals of said optical detector means, for notifying an operator when said optical detector means detects the absence of a fastener within said portion of said fastener supply path.

13. The tool as defined in claim 12, wherein said indicator means comprises a light.

14. The tool as defined in claim 12, wherein said indicator means comprises an audio alarm.

15. The tool as defined in claim 11, wherein:

said means for supplying said combustible fuel to said combustion chamber comprises a solenoid fuel metering valve assembly; and said combustion enabling and disabling means comprises circuit means operatively connecting said optical detector means and said solenoid fuel metering valve assembly and responsive to said signals of said optical detector means for enabling said said solenoid fuel metering valve assembly when said optical detector means detects the presence of a fastener within said portion of said fastener supply path, and for disabling said solenoid fuel metering valve assembly when said optical detector means detects the absence of a fastener within said portion of said fastener supply path.

16. The tool as defined in claim 11, wherein:

said combustible fuel igniting means comprises a spark coil; and said circuit means comprises means operatively connecting said optical detector means and said spark coil and responsive to said signals of said optical detector means for enabling said spark coil when said optical detector means detects the presence of a fastener within said portion of said fastener supply path, and for disabling said spark coil when said optical detector means detects the absence of a fastener within said portion of said fastener supply path.

17. The tool as set forth in claim 16, wherein said circuit means comprises:

first and second diodes operatively connected to said spark coil and said solenoid fuel metering valve assembly for providing signals to said spark coil and said solenoid fuel metering valve assembly so as to disable said spark coil and said solenoid fuel metering valve assembly when said optical detector means detects the absence of a fastener within said portion of said fastener supply path;

reference voltage means for providing a reference voltage; and a differential comparator operatively connected to outputs of said optical detector means and said reference voltage means and operatively connected to inputs of said first and second diodes for driving said first and second diodes when said optical detector means detects the absence of a fastener within said portion of said fastener supply path, and for disabling said first and second diodes when said optical detector means detects the presence of a fastener within said portion of said fastener supply path.

18. The tool as defined in claim 11, or wherein:

said optical detector means comprises a light source and a light detector located at a lower portion of said fastener supply assembly so that a fastener at said lower portion of said fastener supply assembly prevents a signal from said light source from reaching said light detector.

19. The tool as set forth in claim 18, wherein:

said optical light source comprises an LED; and said optical light detector comprises a photodetector.

20. The tool as set forth in claim 11, further comprising:

a cylinder operatively connected to said combustion chamber; and a piston disposed within said cylinder for movement toward said nosepiece in response to combustion of said combustible fuel within said combustion chamber;

said driver blade being mounted at a first end portion thereof, which is opposite a second end portion thereof which operatively impacts and drives a fastener, within said piston.

* * * * *